US005924233A

United States Patent [19]

Strobel

[11] Patent Number: 5,924,233

[45] Date of Patent: Jul. 20, 1999

[54] SURVIVAL WEAPON

[76] Inventor: Ronald Lee Strobel, 160 SE 3rd, Bend, Oreg. 97702

[21] Appl. No.: 08/974,949

[22] Filed: Nov. 19, 1997

[51] Int. Cl.[6] ..... F41C 23/00

[52] U.S. Cl. ..... 42/72

[58] Field of Search ..... 42/72, 71.01

[56] References Cited

U.S. PATENT DOCUMENTS

| | | | |
|---|---|---|---|
| 3,369,316 | 2/1968 | Miller | 42/72 |
| 3,618,249 | 11/1971 | Grandy | 42/72 |
| 3,782,019 | 1/1974 | Venturini | 42/72 |
| 4,271,623 | 6/1981 | Beretta | 42/72 |
| 4,788,785 | 12/1988 | White | 42/72 |
| 5,778,588 | 7/1998 | Allen, III et al. | 42/72 |

OTHER PUBLICATIONS

Instruction Manual, New England Firearms Models R22, R73, R92, Standard & Ultra Revolvers, date unknown.
Brochure, Mini Maglite Flashlight, dated May 1996.
Brochure, Buck Knives Buicktool, date unknown.

*Primary Examiner*—Charles T. Jordan
*Assistant Examiner*—Denise J Buckley
*Attorney, Agent, or Firm*—Wells, St. John, Roberts, Gregory & Markin P.S.

[57] ABSTRACT

A survival weapon is described in which a projectile firing weapon mounts a stock member. A connector mounts the stock member to the projectile firing weapon for selective motion between an inoperative position in which the stock member is positioned in juxtaposition to the projectile firing weapon, and an operative position in which the stock member projects outwardly of the projectile firing weapon. The stock member includes compartments releasably receiving survival items such as a fire starting component, a cutting tool, a direction finding device, and ammunition for the projectile firing weapon. An access opening is formed in the stock member that is aligned with the trigger of the weapon and that provides access to the trigger when the stock member is in either the operative or inoperative position. A saw blade and a chopping head may also be provided for attachment to the stock member to enable use of the stock member as a saw or chopping tool.

23 Claims, 7 Drawing Sheets

SURVIVAL WEAPON

TECHNICAL FIELD

The present invention relates to survival weapons.

BACKGROUND OF THE INVENTION

It is relatively common for hunters, hikers, pilots, outfitters, guides, and others to carry a supply of survival equipment when in remote wilderness. It is desirable to minimize the space and weight required for such equipment since emergencies in which the equipment is required seldom occur. The tendency is thus to short-supply the equipment and when an emergency does occur, the situation quickly becomes dangerous due to lack of preparedness.

It is known to provide survival weapons with certain survival provisions such as matches in the stock portion of a firearm. In one instance, the action and barrel of the firearm is also carried in the stock, thus severely reducing the space available that could otherwise be used for survival equipment storage. Further, the action and barrel must be removed and attached to the stock before the firearm can be effectively used. This is a serious and possible fatal drawback when the firearm is needed immediately for defense against a predator.

It is also known to provide firearms with detachable or extendible stocks. Such weapons however are typically not provided with survival features or equipment.

The present invention has for a first object, to provide a projectile firing weapon along with convertible survival features that can be used for survival in wilderness areas.

A further object is to provide such a survival weapon with a movable stock that will permit firing of the weapon with the stock in either a folded, inoperative position, or an extended operative position.

A still further object is to provide such a survival weapon with features that will facilitate cutting or chopping for firemaking, construction of shelters, or other activities that significantly increase the odds for survival in wilderness areas.

These and still further objects and advantages will become apparent upon reading the following description which, along with the appended drawings, describe a preferred mode for carrying out the present invention.

BRIEF DESCRIPTION OF THE DRAWINGS

Preferred embodiments of the invention are described below with reference to the following accompanying drawings.

FIG. 4 is an exploded view of the stock member with survival items removed;

FIG. 7 is an enlarged sectional view taken substantially along line 7—7 in FIG. 3;

FIG. 13 is an end view of the chopping head as viewed from either right or left side in FIG. 12.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
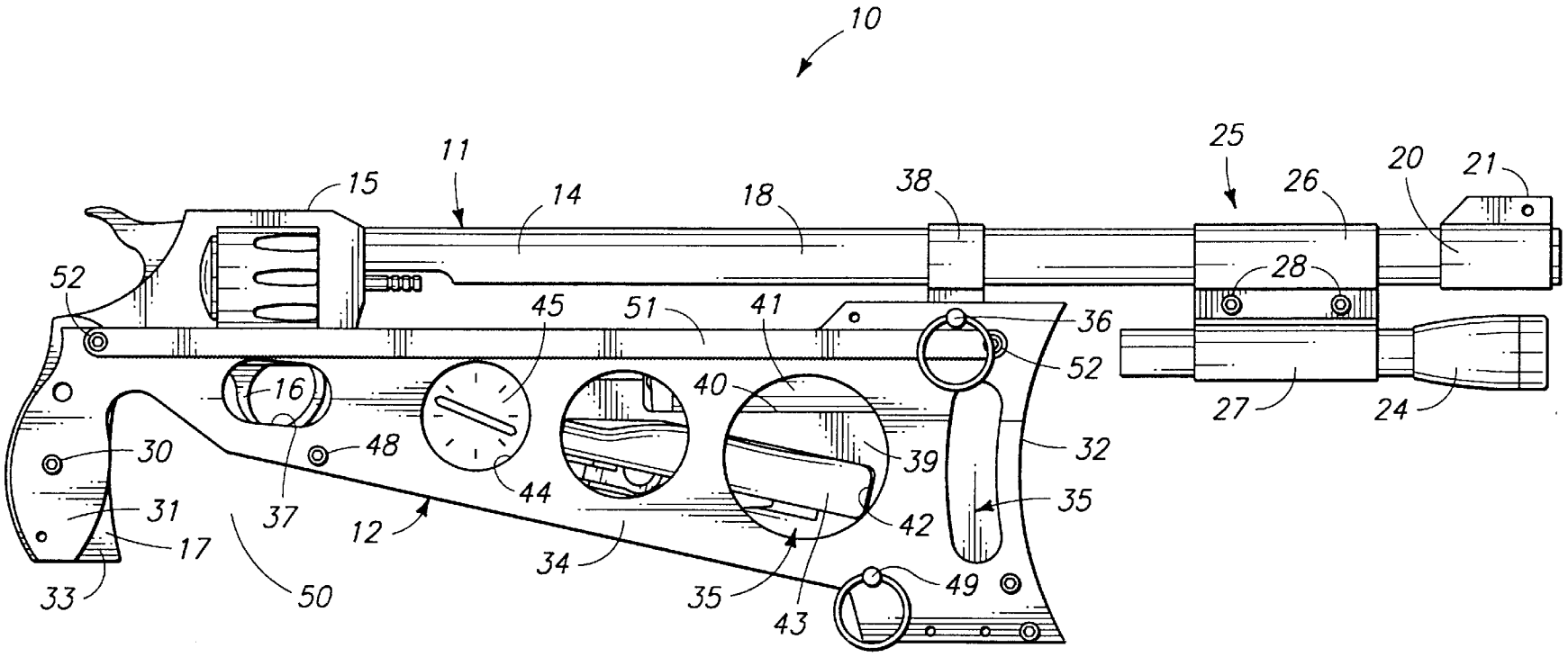
FIG. 1 is a side elevation view of a preferred form of the present survival weapon with a stock member thereof in an inoperative position.
Figure 2:
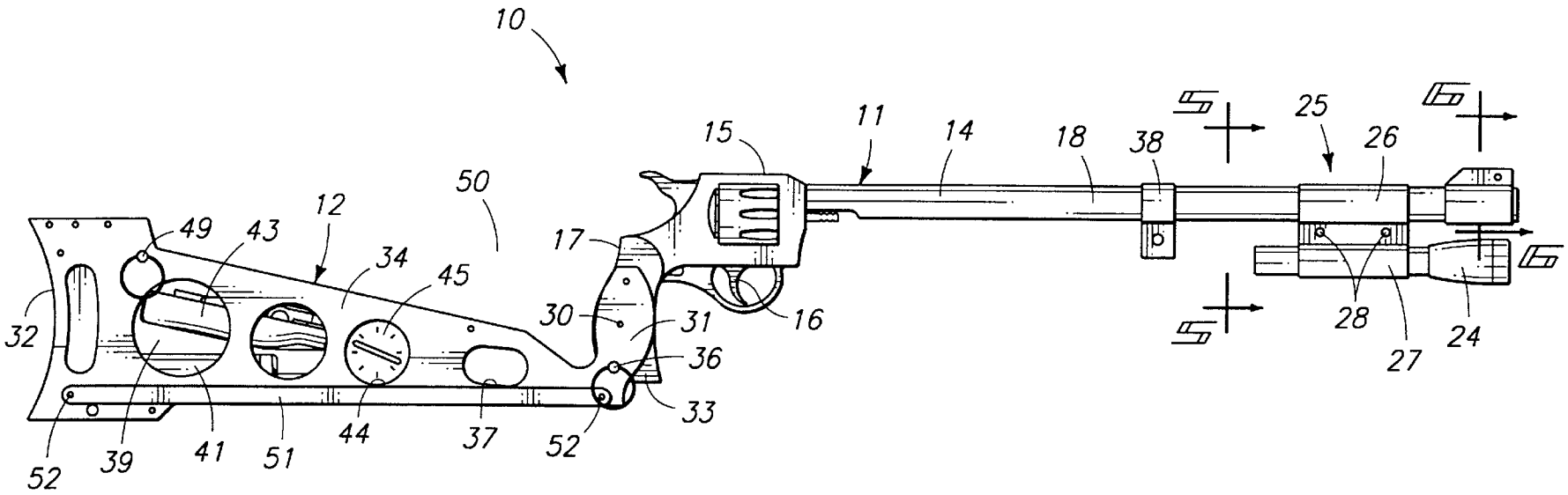
FIG. 2 is a side elevation view with the stock member in an operative position.

A preferred form of survival weapon including features of the present invention is shown in the drawings and is generally designated therein by the reference numeral 10. In a basic form, the weapon 10 includes a projectile firing weapon 11 and a movably attached stock member 12. The stock member 12 is movable on the projectile firing weapon 11 between an inoperative position substantially as shown in FIG. 1 and an operative position as shown in FIG. 2. The stock member may include various survival items that will be discussed in greater detail below.

Attention is drawn to FIGS. 1 and 2 for reference to the projectile firing weapon 11. The weapon 11 is exemplified as a firearm, particularly a revolver. It is pointed out, however, that other weapons could be substituted for the revolver shown. A shotgun, rifle, or semi-automatic pistol (properly adapted) could easily be substituted for the revolver shown. In fact the term "projectile firing weapon" should be understood as substantially any form of weapon that is used to discharge or launch a projectile. Thus the "projectile firing weapon" could also be a crossbow, sling, or another projectile firing or launching device.

In the embodiment shown, the projectile firing weapon includes a barrel 14 connected to a conventional double action frame and cylinder 15, and firing mechanism operated by a conventional trigger 16. A hand grip or handle 17 is also provided immediately behind the trigger 16 and frame 15.

It is pointed out that the firearm mechanisms generally described above are well know in the industry and will not be described in detail herein. In one preferred example, a NEW ENGLAND FIREARMS™ model R92 22 caliber pistol, produced by the NEW ENGLAND FIREARMS company of Gardner, Mass. is used in slightly modified form. Modification steps include removing the standard pistol grip side plates (not shown) and modifying the barrel 13 by press fitting, sweating, silver soldering, or otherwise rigidly attaching an extension tube 18 over the original pistol barrel to increase the overall barrel length to approximately 16 inches. The extended barrel 14 thus conforms to barrel length regulations in the U.S. and accommodates preferred features described below.

Figure 6:
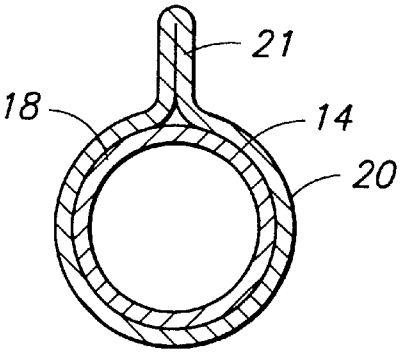
FIG. 6 is an enlarged sectional view taken substantially along line 6—6 in FIG. 2.

In a preferred form, a front sight member 20 is provided on the barrel 14. The sight member 20 is advantageously formed of a metal tube (FIG. 6) that is crimped onto the barrel 14 at the muzzle end. The crimped portion of the metal tube forms a sight blade 21 that is spaced a maximum distance from the action 18 to maximize sighting accuracy.

A flashlight 24 may also be mounted to the barrel 14 adjacent the muzzle end. The flashlight may be of a conventional form such as the "MINI MAGLITE" brand, model LR06 flashlight produced and distributed by MAG Instrument of Ontario, Calif. USA. Other brands and forms of flashlights may also be utilized.

A flashlight mounting bracket 25 releasably mounts the flashlight 24 to the barrel 14 in substantial parallel relation to the barrel. The preferred flashlight mounting bracket 25 is formed of a metal sheet bent into a figure eight configuration with a top loop 26 of the configuration receiving the barrel 14 and a bottom loop 27 of the configuration receiving the flashlight 24.

Figure 5:
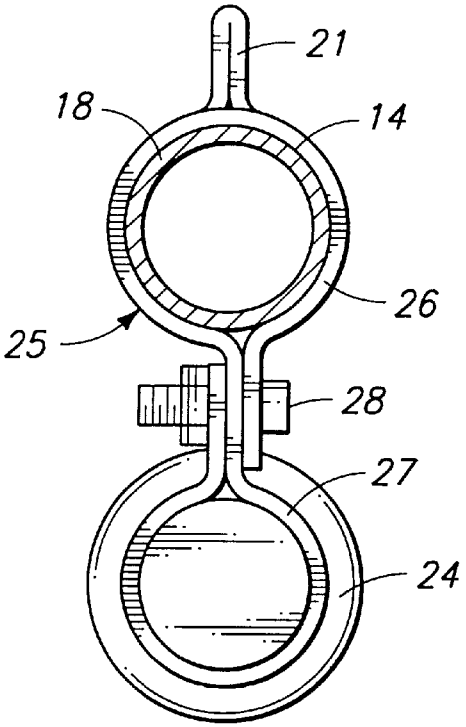
FIG. 5 is an enlarged sectional view taken substantially along line 5—5 in FIG. 2.

Ends of the metal sheet overlap in the area between the loops 26, 27 as shown in FIG. 5 and are connected by fasteners 28 which extend through the sheet and are in threaded engagement therewith to releasably clamp the barrel 14 and flashlight 24 in position, parallel with the barrel 14. The fasteners may be selectively tightened, causing the bracket to simultaneously clamp the barrel 14 and flashlight; or loosened, causing the bracket to simultaneously loosen on the barrel 14 and flashlight 24 so the flashlight 24 may be removed and operated separately from the weapon 11.

Figure 11:
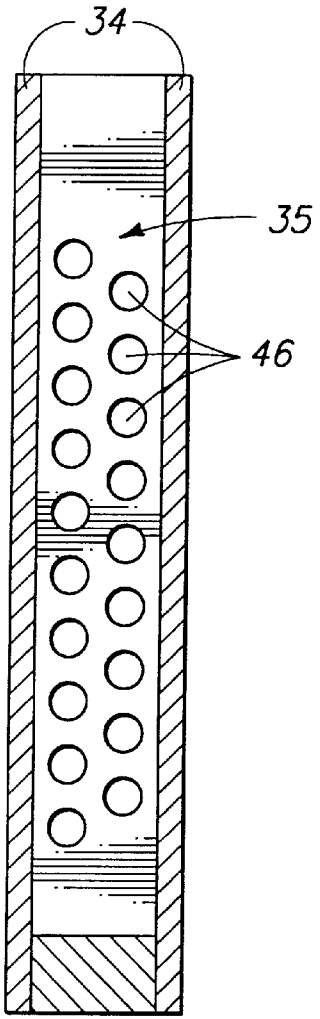
FIG. 11 is a side view of the stock member and a chopping head assembled as a chopping tool.
Figures 8, 9, 10, 11:
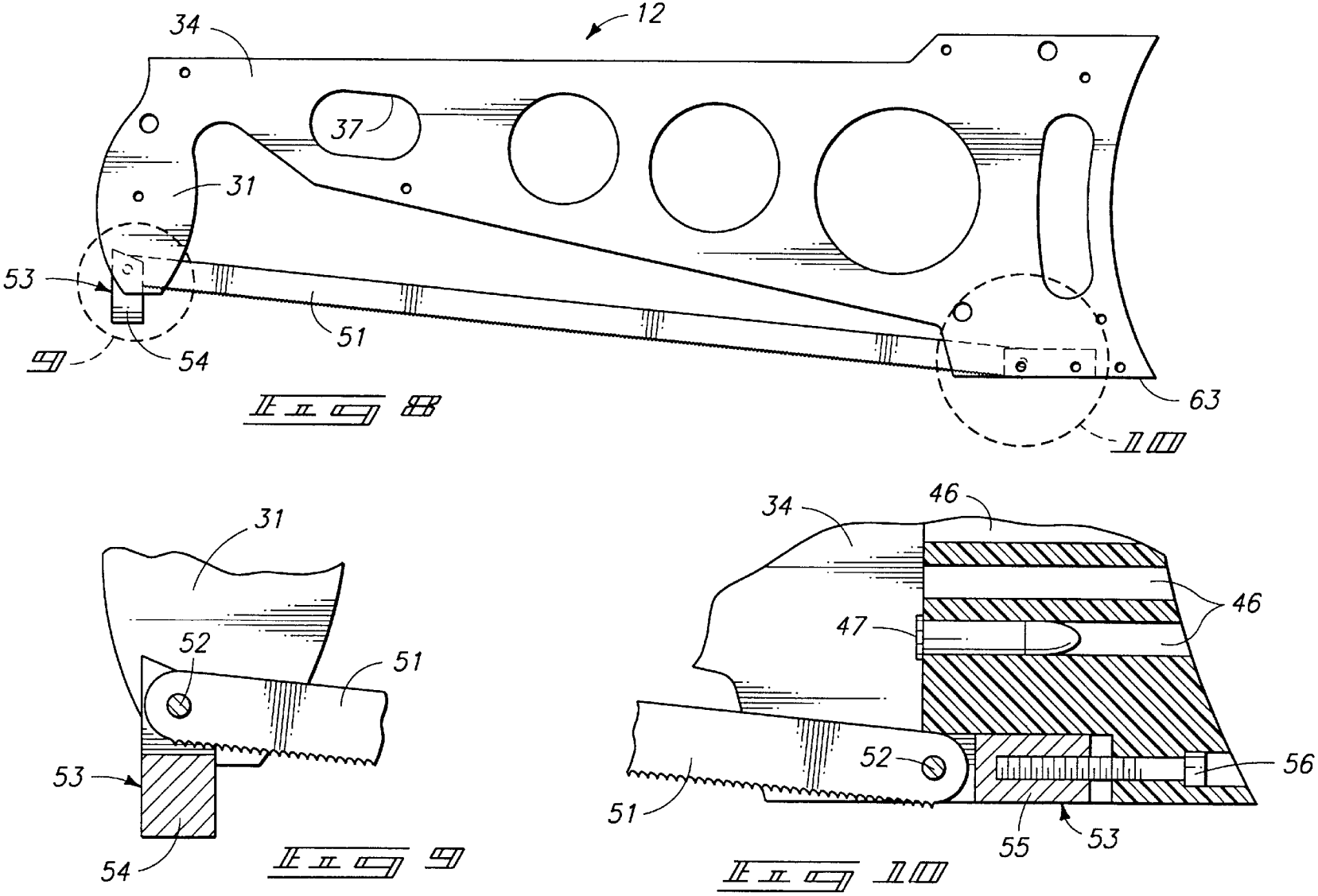
FIG. 8 is a side view of the stock member and a saw blade set up as a saw.
FIG. 9 is an enlarged detail 'sectional view of the area identified at 9 in FIG. 8.
FIG. 10 is an enlarged detail sectional view of the area identified at 10 in FIG. 8.
Figure 11:
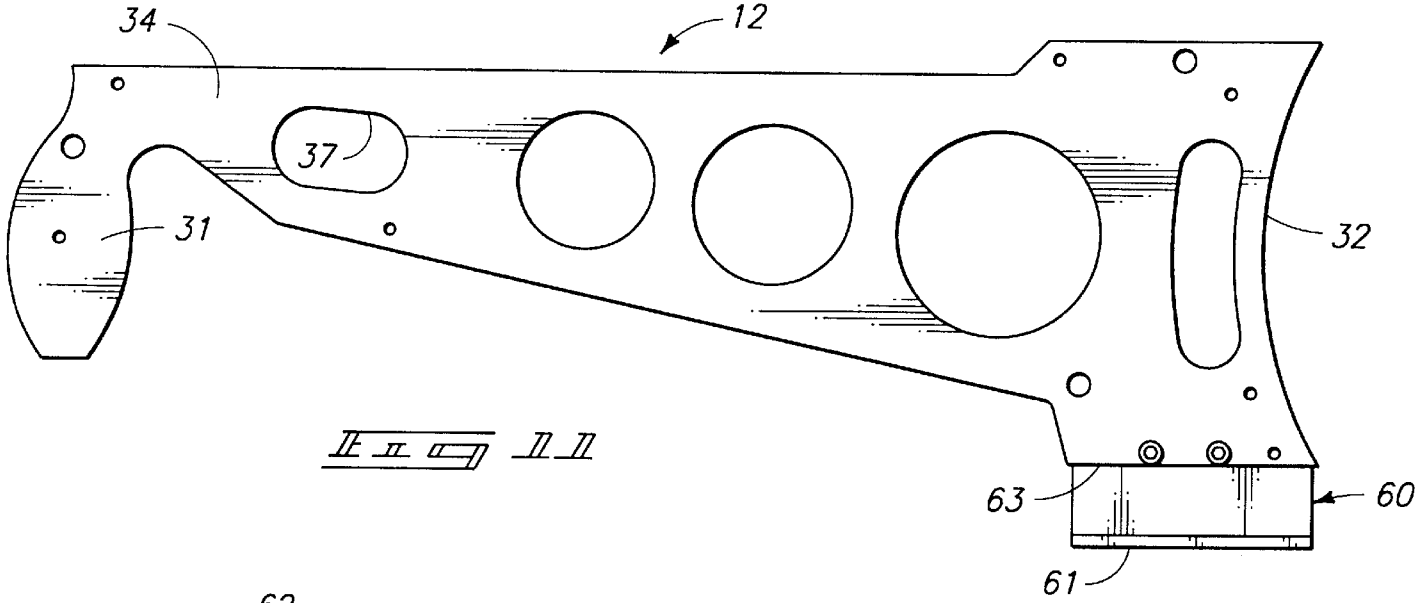
Figure 11:
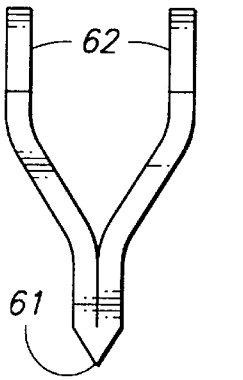

The stock member 12 is shown in detail by FIGS. 1–4, and in different operational modes in FIGS. 8 and 11. In general, the stock member 12 is elongated and in a preferred form, extends from hand grip plate or flanges 31 at a forward end, to a butt plate 32 at a rearward end. The stock member 12 is preferably mounted at the flanges 31 by a connector 30 to the hand grip 17 of the weapon 11 for movement thereon between the inoperative position (FIG. 1) and an operative position (FIG. 2). Alternatively, the stock member 12 can be removed completely from the weapon 11 for alternate uses as shown in FIGS. 8 and 11.

The connector 30 is provided as a screw, extending through the flanges 31 and replacement grip plates 33 that are mounted in place of the removed hand grip plates (not shown) on the hand grip 17. The connector pivotably mounts the stock member 12 to the weapon 11. The screw is centrally located along the flanges 31 and hand grip 17, so the flanges will occupy substantially the same space whether the stock member is in the inoperative position (FIG. 1) or the operative position (FIG. 2). The configuration of the hand grip flanges 31 and positioning of the flanges on the stock member 11 is such that the flanges will not interfere with normal gripping of the weapon hand grip 17, whether the stock member is in the operative or inoperative position.

The preferred stock member includes a pair of rigid side plates 34 formed of a rigid material such as steel or aluminum, sandwiching a liner 35. The liner 35 may be formed in sections of a semi-rigid material such as an appropriate plastic, of a thickness selected to space the side plates 34 apart by a distance substantially equal to the thickness dimension of the weapon hand grip 17. The preferred hand grip plate flanges 31 are integral with the side plates 34 and are arranged on the stock member with a space between the flanges to slidably receive the hand grip.

The preferred stock member 11 is also provided with trigger access openings 37 that are situated in alignment with the weapon trigger 16 when the stock member is in the inoperative position. The access openings 37 allow finger access to the trigger 16 as shown in FIG. 1. The access openings are formed through both side plates 34.

The stock member 14 is releasably secured in the inoperative position by provision of a lock pin 36. The pin extends through the stock member 12 and a hanger bracket 38 on the barrel 14. By pulling the pin, the stock is released and is free to swing on the axis of connector 30 to the operative position. Appropriate holes are provided through the hand grip plate flanges 31 and replacement grip plates 33 to accept the pin 36, which is also used to lock the stock member 12 in the operative position (FIG. 2).

The liner 35 is preferably formed in sections of a plastic material such as ultra high molecular weight polyethylene (UHMW) and may be provided with a swing-out section 39 having multiple compartments for receiving various survival items. The swing-out section 39 is pivotably mounted between the side plates 34 by a screw 48 and a lock pin 49. The lock pin 49 may be pulled to allow the swing-out section 39 to be pivoted outwardly of the stock member 12, permitting access to the survival items held therein. Of course the screw 48 and lock pin 49 can both be removed to enable complete separation of the swing-out section 39 if so desired.

Figure 3:
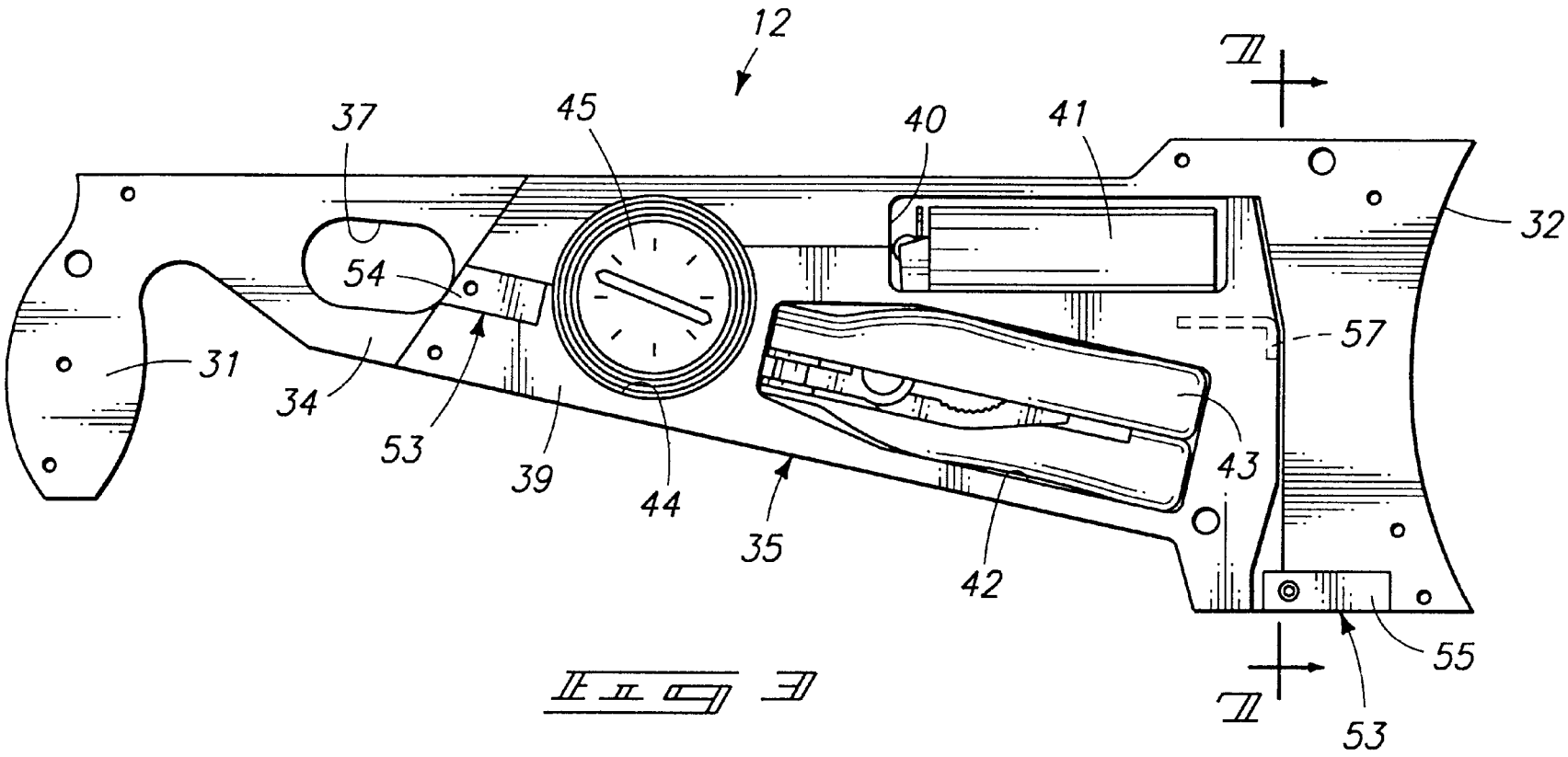
FIG. 3 is a fragmented side view of the stock with a side plate removed to show containment of survival items.
Figure 3:
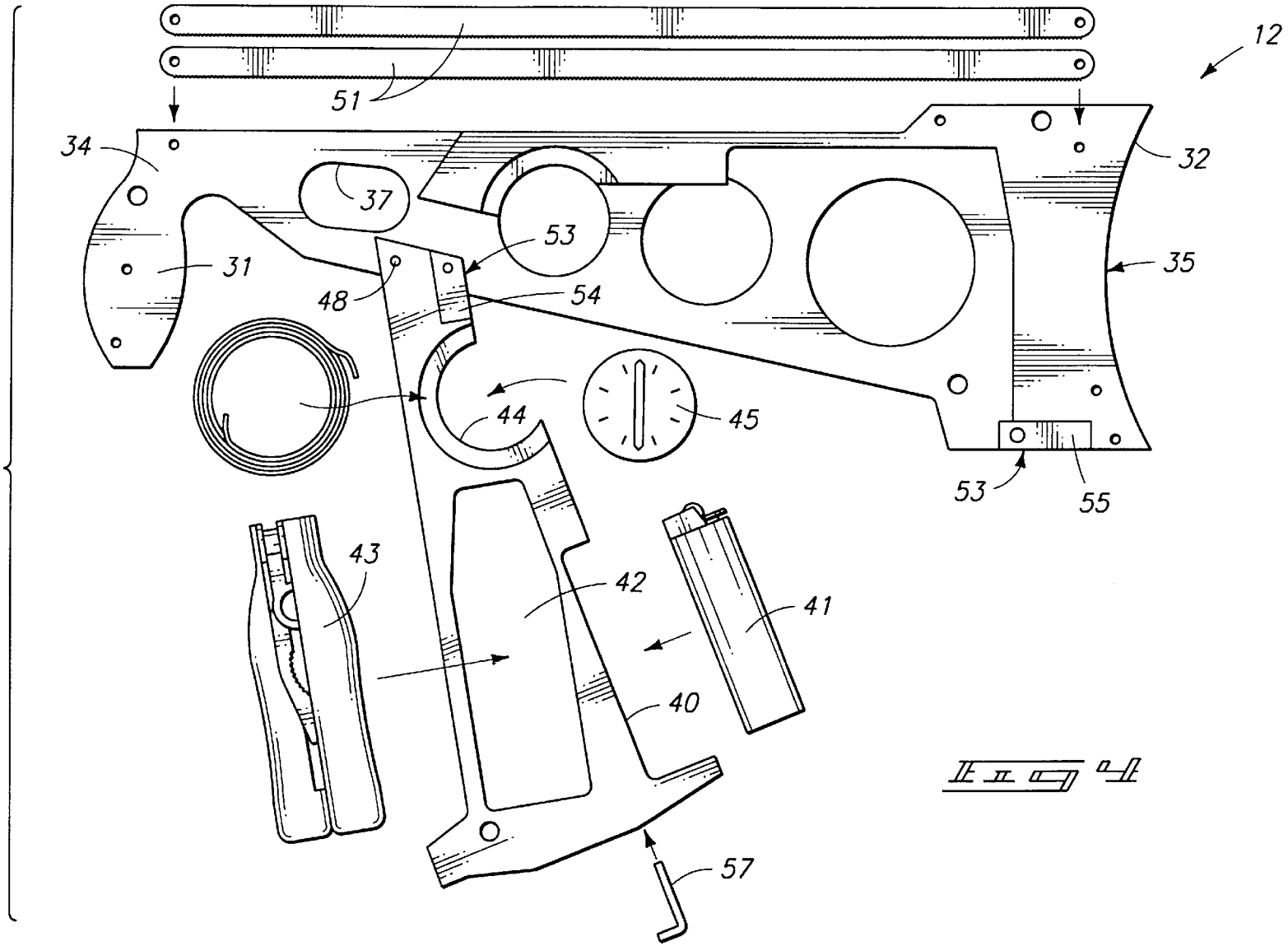

In the example illustrated in FIG. 3, the compartments provided in the swing-out section 39 include a compartment 40 for releasably receiving a fire starting component such as a conventional butane lighter 41.

Another compartment 42 is shaped in the swing-out section 39 to mount a cutting tool 43. As shown, the cutting tool 43 is a multi purpose tool, having various accessories. An example of such a tool that is useful with the present invention is the "BUCKTOOL"™ brand multi purpose folding tool produced and distributed by Buck Knives of El Cajon, Calif. USA.

A still further compartment 45 is provided in the swing-out section 39 to mount a direction finder, such as the compass 45. A roll of cord or wire 46 may also be provided, wound around the compass 45 and positionable within the compartment 45.

Multiple compartments 46 may be provided in the liner 35 for ammunition 47 (FIG. 7, 10). As shown in FIG. 10, the compartments 46 are not provided in the swing-out section 39, but rather in another part of the liner 35 that is permanently secured between the side plates 34. Of course, other similar compartments could be provided as needed in the swing-out section 39 or elsewhere on the liner 35 to receive more ammunition.

As shown in FIG. 4, the swing-out section 39 may be removed from between the side plates 34 by removing screw 48 and the lock pin 49 to facilitate access to the survival items exemplified above. The screw 48 and other similar screws are used in the stock member 12 to releasably secure components in place. In a preferred form, alien head screws may be used, with an allen wrench 57 provided in another appropriate recess formed for easy access in the swing-out section 39 of the liner 35. It is also envisioned that the allen wrench be could be provided as a folding part of the cutting tool 43.

A preferred form of the present survival weapon 10 includes a recess 50 formed along the stock member 12. The preferred recess 50 extends along the stock member between the butt plate 32 and the hand grip flange plates 31, providing an open "throat" area when the stock member is to be used as a saw (FIG. 8). To this end, at least one and preferably two saw blades 51 are provided. The blades 51 may be conventional hack saw blades, one having a fine tooth pattern for metal work, and another having coarser teeth for wood.

A first blade mount 52 releasably secures the saw blades 51 to the stock member in an inoperative storage condition.

The mount may be comprised of allen head screws threadably clamping the blades to the stock member above the recess (FIGS. 1, 2). The screws may be selectively removed to permit repositioning of one blade 51 to a lower, operative position.

A second blade mount 53 is provided to releasably secure the selected saw blade 51 to the stock member 12 in the operative position, spanning the recess 50. The mount 53 includes a front mount member 54, comprised of a slotted spacer formed of the same material as the liner 35. Mount 52 further includes a similarly slotted rear mount member 55 that is movably secured between the side plates 34 by engagement with a blade tensioner 56 on the stock member. The blade tensioner 56 is selectively operable to adjustably tension the blade 51 when in the operative position.

The blade tensioner 56 is comprised of a threaded screw, preferably an allen head screw, that is threaded into the rear mount member 55 and rotatably mounted to the liner 35 adjacent the butt plate 32. By selectively turning the screw, the user is able to shift the rear mount member 55 toward or away from the front mount member, thereby loosening or tightening the blade in a manner similar to loosening or tightening a blade in a conventional hack saw or coping saw. The same screws used as the first mount 52 may be used to attach the blade to the front and rear mount members 54, 55.

Figure 12:
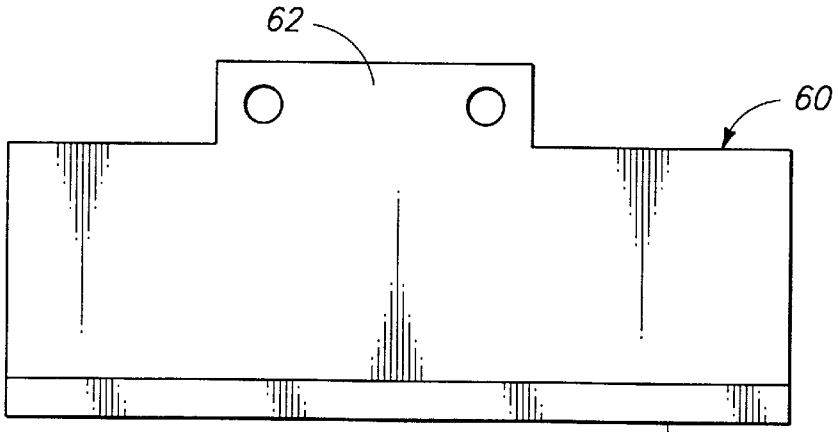
FIG. 12 is an enlarged side elevation view of the chopping head.

A chopping head 60 may be provided in a kit form of the present device, carried separately from the remaining survival items. The chopping head 60 is preferably a steel plate formed in a "V" configuration, with a chopping edge 61 at the vertex of the "V" configuration (FIG. 13). Mounting flanges 62 (FIG. 12) are provided on the chopping head 60 opposite the chopping edge 61. The flanges 62 are provided to secure the chopping head 60 to the stock member 12 at a mount 63 adjacent the butt 34 as shown in FIG. 11. Screws available from elsewhere on the stock member 12 may be used to secure the head 60 in position.

It is noted that the chopping head 60 is mounted to the stock member 12 adjacent the butt end 32 and that the hand grip plate flanges 31 may be used as a handle. The stock member 12 thus serves as an extended handle for the chopping head 60 and allows use as a hatchet.

Operation of the present invention will be explained starting with the present survival weapon 10 in the condition shown in FIG. 1 of the drawings.

The survival weapon 10 is presented in a compact, easily stored or carried configuration with the stock member 12 folded and secured in the inoperative condition shown in FIG. 1. However, the projectile firing weapon 11 may be used if desired or necessary while the stock member 12 is situated in the inoperative position. The user need only grasp the hand grip 17, aim, and pull the trigger 16. No parts of the stock member 12, liner 35, or other survival items will interfere with needed operation of the weapon 11.

If time permits, and the weapon is to be used as a rifle, the lock pin 36 may be pulled and the stock member can be pivoted on the axis of connector 30 approximately 180° to the operative position shown in FIG. 2. The pin 36 may then be fitted through the appropriate holes in the hand grip flange plates 31 and hand grip 17 to secure the stock member in the operative position. The weapon may now be used as a rifle, with greater sighting accuracy assured through provision of the barrel extension and front sight 20, and through use of the stock member 12 in a manner similar to a conventional rifle or shotgun. The flashlight 24 may be activated advantageously at this point to illuminate the target area.

If survival items within the liner area are to be used, the second pin 49 may be pulled to permit the swing-out section 39 of the liner to be pivoted outwardly for access to the items held therein. The lighter 41 may be removed for fire starting. The cutting tool 43 can be removed to perform cutting or other operations available by way of the other various fold-out tools provided therein. Also the compass and cord can be removed if desired. Still further, the allen wrench 57 is now accessible to be removed to enable assembly of other features described below.

If there is need for a saw, lock pin 36 can be pulled and the stock member 12 can be removed by removing the connector 30 using the allen wrench 57. The saw blades 51 can now be removed using the same allen wrench, by removing the screws comprising the first blade mount 52. One of the blades 51 is now selected according to the material to be cut. The selected blade 51 can be mounted, using the same screws, to the mounting members 54, 55 to the stock member as shown in FIG. 8. The blade tensioner screw 56 may be adjusted using the allen wrench to facilitate mounting and subsequent tensioning of the blade. Now the stock member 12 will function well as a saw, with the hand grip plate flanges 31 used as the saw handle.

If chopping is required, the chopping head 60 is attached to the removed stock member in the position shown in FIG. 11, and the stock member now becomes an effective hatchet, again using the hand grip flanges 31 as a handle. It is advisable due to the typical jarring effects of chopping action, and for purposes of weight reduction that the swing out section 39 and components held therein be removed prior to chopping.

With all the capabilities provided by the present survival weapon 10, a user in an emergency situation or otherwise will have tools readily at hand to take game for food, defend against attack by predators, provide warmth, construct shelter or other tools, and to obtain directional guidance if such is needed.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A survival weapon, comprising:

a projectile firing weapon including a trigger;

a stock member;

a trigger access opening in the stock member;

a connector, mounting the stock member to the projectile firing weapon for selective pivotal motion between an inoperative position in which the stock member is positioned in juxtaposition to the projectile firing weapon, and an operative position in which the stock member projects outwardly of the projectile firing weapon;

wherein the trigger access opening is positioned on the stock member to enable finger access to the trigger with the stock member in the inoperative position.

2. A survival weapon as defined by claim 1, wherein the stock member includes internal compartments for reception of survival items.

3. A survival weapon as defined by claim 1, wherein the stock member includes an internal liner releasably secured to the stock member, provided with compartments configured to receive survival gear including a fire starting component, a cutting tool, a direction finding device, and ammunition for the projectile firing weapon.

4. A survival weapon as defined by claim 1, wherein the projectile firing weapon is a firearm having a barrel extending to a muzzle end, and further comprising:

a front sight member formed of a metal tube crimped onto the barrel with a sight blade comprised of a crimped portion of the tube.

5. A survival weapon as defined by claim 1, wherein the projectile firing weapon is a firearm having a barrel, and further comprising;

a flashlight;

a flashlight mounting bracket releasably mounting the flashlight to the barrel in substantial parallel relation to the barrel; and wherein the flashlight mounting bracket is formed of a metal sheet bent into a figure eight configuration with a top loop of the configuration receiving the barrel and a bottom loop of the configuration receiving the flashlight.

6. A survival weapon as defined by claim 1, wherein the connector is a pin removably mounting the stock member to the projectile firing weapon.

7. A survival weapon as defined by claim 1, wherein the connector is a pin releasably projecting through the stock member and the projectile firing weapon, and positioned to enable: removal of the stock member from the projectile firing weapon; and pivotal movement of the stock member on a pivot axis defined by the pin between the operative and inoperative positions.

8. A survival weapon, comprising:

a projectile firing weapon;

a stock member;

a connector, mounting the stock member to the projectile firing weapon for selective positioning between an inoperative position in which the stock member is positioned in juxtaposition to the projectile firing weapon, and an operative position in which the stock member projects outwardly of the projectile firing weapon;

a recess formed along the stock member;

a saw blade;

a first blade mount releasably securing the saw blade to the stock member in an inoperative storage condition; and a second blade mount releasably securing the saw blade to the stock member in an operative position, spanning the recess.

9. A survival weapon as defined by claim 8, wherein the saw blade is a conventional hack saw blade.

10. A survival weapon as defined by claim 8, wherein the second blade mount includes a blade tensioner on the stock member, selectively operable to adjustably tension the blade in the operative position.

11. A survival weapon as defined by claim 8, wherein the saw blade is a conventional hack saw blade and wherein the second blade mount includes a blade tensioner on the stock member, selectively operable to adjustably tension the blade in the operative position.

12. A survival weapon as defined by claim 8, wherein the stock member is comprised of a pair of side plates formed of a rigid material, and sandwiching a liner, said liner including compartments configured to releasably mount survival items.

13. A survival weapon as defined by claim 8, wherein the stock member is comprised of a pair of side plates formed of a rigid material, and sandwiching a liner, said liner including compartments configured to releasably mount survival items; and wherein the liner is configured to include the second blade mount.

14. A survival weapon, comprising:

a projectile firing weapon including an integral hand grip;

an elongated stock member including a hand grip plate at one end;

a connector, mounting the stock member to the projectile firing weapon for selective pivotal motion between an inoperative position in which the stock member is positioned in juxtaposition to the projectile firing weapon, and an operative position in which the stock member projects outwardly of the projectile firing weapon; and wherein the hand grip plate is shaped similarly to the hand grip and positioned in relation to the connector to substantially engage and conform to the hand grip at both operative and inoperative positions.

15. A survival weapon as defined by claim 14, wherein the stock member includes a rifle butt plate at an end thereof opposite the hand grip plate.

16. A survival weapon as defined by claim 14, wherein the stock member includes a pair of side plates; and wherein the hand grip plate is formed by a pair of flanges formed by the side plates with a space between the flanges slidably receiving the hand grip.

17. A survival weapon as defined by claim 14, wherein the stock member includes a pair of side plates formed of a rigid material, and sandwiching a liner, said liner spacing the side plates apart a distance substantially equaling a thickness dimension of the hand grip; and wherein the hand grip plate is formed by a pair of flanges formed by the side plates with a space between the flanges slidably receiving the hand grip.

18. A survival weapon as defined by claim 14, wherein the stock member includes a pair of side plates formed of a rigid material, and sandwiching a liner, said liner spacing the side plates apart a distance substantially equaling a thickness dimension of the hand grip; and wherein the liner includes internal compartments for reception of survival items.

19. A survival weapon as defined by claim 14, wherein the connector is comprised of a pin releasably projecting through the stock member hand grip plate and the hand grip of the projectile firing weapon.

20. A survival weapon as defined by claim 14, wherein the connector is a pin releasably projecting through the stock member hand grip plate and the projectile firing weapon, and positioned to enable: removal of the stock member from the projectile firing weapon; and pivotal movement of the stock member on a pivot axis defined by the pin between the operative and inoperative positions.

21. A survival weapon kit, comprising:

a projectile firing weapon;

a stock member;

survival items including a fire starting component, a cutting tool, a direction finding device, and ammunition for the projectile firing weapon;

the stock member including compartments for releasably storing the survival items;

a connector mounting the stock member to the projectile firing weapon, for selective positioning between an inoperative position in which the stock member is positioned in juxtaposition to the projectile firing weapon, and an operative position in which the stock member projects outwardly of the projectile firing weapon;

a chopping head; and a chopping head mount on the stock member for releasably mounting the chopping head in an operational condition enabling the stock member to be used as a chopping tool.

22. A survival weapon as defined by claim 21, wherein the stock member is elongated and includes a rifle butt plate at one end thereof and a hand grip plate at an opposite end, and wherein the chopping head mount is situated at the one end.

23. A survival weapon as defined by claim 21, wherein the chopping head is comprised of a steel plate formed in a "V" configuration, with a chopping edge at the vertex of the "V" configuration and mounting flanges opposite the chopping edge.

* * * * *

UNITED STATES PATENT AND TRADEMARK OFFICE

CERTIFICATE OF CORRECTION

PATENT NO. : 5,924,233

DATED : July 20, 1999

INVENTOR(S) : Ronald Lee Strobel

It is certified that error appears in the above-identified patent and that said Letters Patent is hereby corrected as shown below:

Col. 4, l. 50: Replace "alien" with --allen--

Signed and Sealed this

Seventh Day of December, 1999

*Attest:*

Q. TODD DICKINSON

*Attesting Officer*

*Acting Commissioner of Patents and Trademarks*